US009979113B2

(12) United States Patent
Li et al.

(10) Patent No.: US 9,979,113 B2
(45) Date of Patent: May 22, 2018

(54) ELECTRICAL CONNECTOR AND ASSEMBLY THEREOF

(71) Applicant: FOXCONN INTERCONNECT TECHNOLOGY LIMITED, Grand Cayman (KY)

(72) Inventors: Dong Li, Kunshan (CN); Zhi-Hui Zhu, Kunshan (CN); Xiao Wang, Kunshan (CN); Shu-Jian Wang, Kunshan (CN); Yen-Chih Chang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/482,832

(22) Filed: Apr. 10, 2017

(65) Prior Publication Data

US 2017/0294729 A1 Oct. 12, 2017

(30) Foreign Application Priority Data

Apr. 8, 2016 (CN) ..... 2016 2 0287165 U

(51) Int. Cl.
*H01R 13/648* (2006.01)
*H01R 13/24* (2006.01)
(Continued)

(52) U.S. Cl.
CPC ..... *H01R 13/2457* (2013.01); *H01R 12/714* (2013.01); *H01R 12/73* (2013.01);
(Continued)

(58) Field of Classification Search
CPC ..... H01R 13/2457
(Continued)

(56) References Cited

U.S. PATENT DOCUMENTS 5,746,607 A * 5/1998 Bricaud ..... H01R 12/714 439/630
5,975,959 A * 11/1999 Joly ..... G06K 7/0021 439/630

(Continued)

FOREIGN PATENT DOCUMENTS

CN 2563779 Y 7/2003
TW 201533986 A 9/2015

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector comprises an insulative housing extending in a horizontal direction and a plurality of conductive terminals retained in the insulative housing. The electrical connector is provided with a first receiving cavity and a second receiving cavity which are arranged in an up-and-down arrangement in a vertical direction perpendicular to the horizontal direction. Each conductive terminals comprises a first contact portion extending upwardly into the first receiving cavity and a second contact portion extending downwardly into the second receiving cavity. The conductive terminals are used to electrically connect a pair of first and second electrical components which are respectively inserted into the first and second receiving cavity via the first and second contact portions. The electrical connector is provided with the receiving cavity for inserting the second electrical component, thereby facilitating the assembly of the second electrical component and the electrical connector.

15 Claims, 6 Drawing Sheets

(51) Int. Cl.
*H01R 13/506* (2006.01)
*H01R 13/6581* (2011.01)
*H01R 13/66* (2006.01)
*H01R 12/71* (2011.01)
*H01R 12/73* (2011.01)

(52) U.S. Cl.
CPC ..... *H01R 13/2435* (2013.01); *H01R 13/506* (2013.01); *H01R 13/6581* (2013.01); *H01R 13/665* (2013.01)

(58) Field of Classification Search
USPC ..... 439/607.22, 631, 633
See application file for complete search history.

(56) References Cited

U.S. PATENT DOCUMENTS 6,210,233 B1 * 4/2001 Hoolhorst ..... G06K 7/0021 439/326
6,511,349 B2 * 1/2003 Ishikawa ..... H01R 12/774 439/327
6,558,175 B1 * 5/2003 Yu ..... G06K 13/0875 361/737
6,623,305 B2 * 9/2003 Chun-Lung ..... G06K 7/0021 439/108
6,666,724 B1 * 12/2003 Lwee ..... G06K 7/0043 439/138
6,717,817 B2 * 4/2004 Liu ..... G06K 7/0021 235/486
6,896,548 B2 * 5/2005 Scuteri ..... G06K 7/0021 439/326
7,048,588 B2 * 5/2006 Chang ..... G06K 13/0825 439/630
7,182,645 B2 * 2/2007 Shimizu ..... G06K 7/0021 439/157
7,494,380 B2 * 2/2009 Lai ..... H01R 27/00 439/630
7,530,852 B2 * 5/2009 Hu ..... H01R 13/502 439/630
7,726,991 B2 * 6/2010 Ma ..... H01R 13/703 439/188
7,744,421 B2 * 6/2010 Harada ..... H01R 12/57 439/630
8,070,521 B2 * 12/2011 Li ..... H01R 12/00 439/631
8,419,478 B2 * 4/2013 Liu ..... H01R 25/00 439/159
9,065,204 B2 * 6/2015 Wan ..... H01R 13/62
2009/0035971 A1 2/2009 Tsuji
2013/0059478 A1 * 3/2013 Liu ..... H01R 25/00 439/631

* cited by examiner

ELECTRICAL CONNECTOR AND ASSEMBLY THEREOF

BACKGROUND OF THE INVENTION

1. Field of the Invention

The present invention relates generally to an electrical connector and assembly thereof, more particularly to an electrical connector connected to a first electrical component and a second electrical component.

2. Description of Related Arts

Taiwan patent application publication No. TW201533986 published on Sep. 1, 2015, discloses a card connector used to receive an electrical card including an insulative housing, a plurality of contact terminals received in the insulative housing, a metal shell shielding the insulative housing, a receiving room surrounded by the insulative housing and the metal shell. Each of the contact terminals is provided with a contact portion extending into the receiving room and a welding portion extending out of the insulating housing for welding to a circuit board. The technology of fixing the conductive terminal on the circuit board by welding is complex, which is not conducive to the improvement of production efficiency.

Hence, a new electrical connector is desired to improve those disclosed in the aforementioned proposal.

SUMMARY OF THE INVENTION

Accordingly, the object of the present invention is to provide a electrical connector which is convenient for the assembly of the electrical connector and a circuit board.

To fulfill the above-mentioned object, an electrical connector comprises an insulative housing extending in a horizontal direction and a plurality of conductive terminals retained in the insulative housing. The electrical connector is provided with a first receiving cavity and a second receiving cavity which are arranged in an up-and-down arrangement in a vertical direction perpendicular to the horizontal direction. Each of the conductive terminals comprises a first contact portion extending upwardly into the first receiving cavity and a second contact portion extending downwardly into the second receiving cavity. The conductive terminals are used to electrically connect a pair of first and second electrical components which are respectively inserted into the first receiving cavity and the second receiving cavity via the first and second contact portions contacting with the first and second electrical components respectively. The electrical connector is provided with the receiving cavity for inserting the circuit board, thereby facilitating the assembly of the circuit board and the electrical connector.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
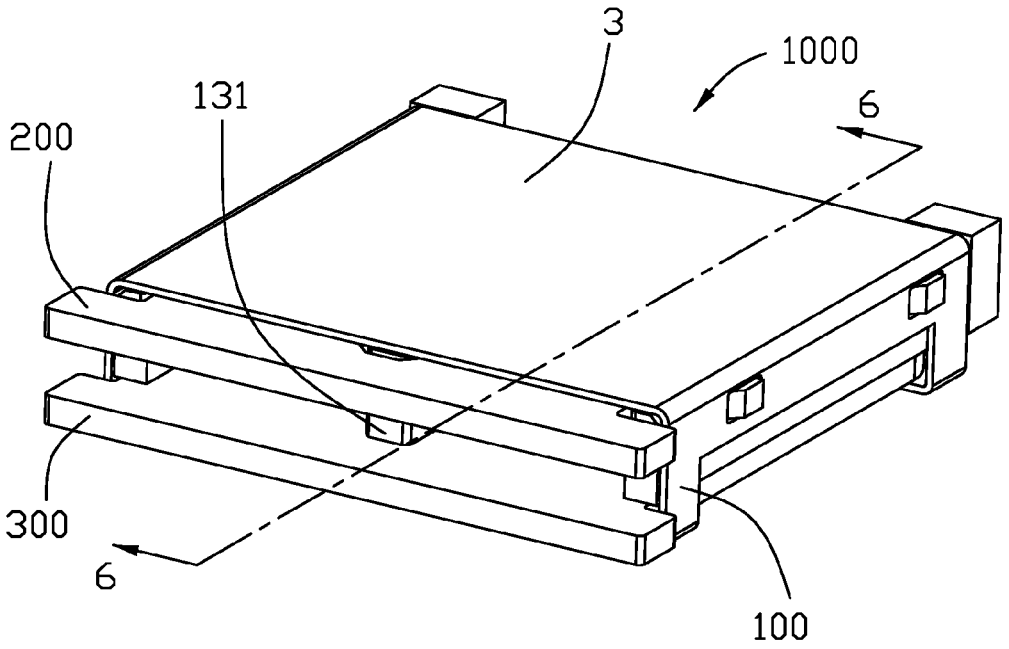
FIG. 1 is a top perspective view of an electrical connector assembly which a first electrical component and a second electrical component are inserted into the electrical connector.
Figure 2:
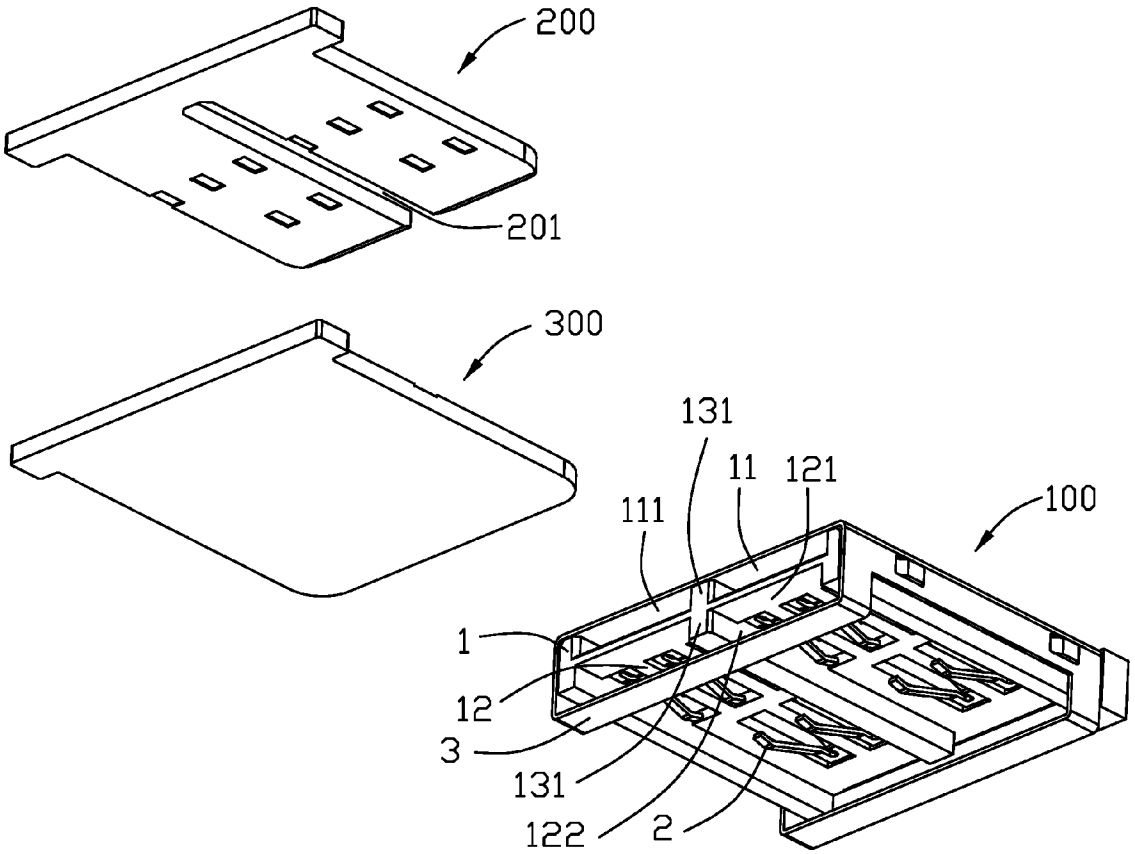
FIG. 2 is a bottom exploded perspective view of the electrical connector assembly shown in FIG. 1.

Referring to FIGS. 1-2, an electrical connector assembly 1000 comprises an electrical connector 100 mounted in a horizontal direction, a first electrical component 200 mating with the electrical connector 100 and a second electrical component 300 mating with the electrical connector 100. The electrical connector assembly 1000 can be used for a device such as a game machine, a mobile phone, etc. that needs to be electrically connected or disengaged by sliding, but is not limited thereto. The first electronic component 200 and the second electronic component 300 may be provided as a PCB or a FPC. The structure of the electrical connector 100 is specifically described below.

Figure 3:
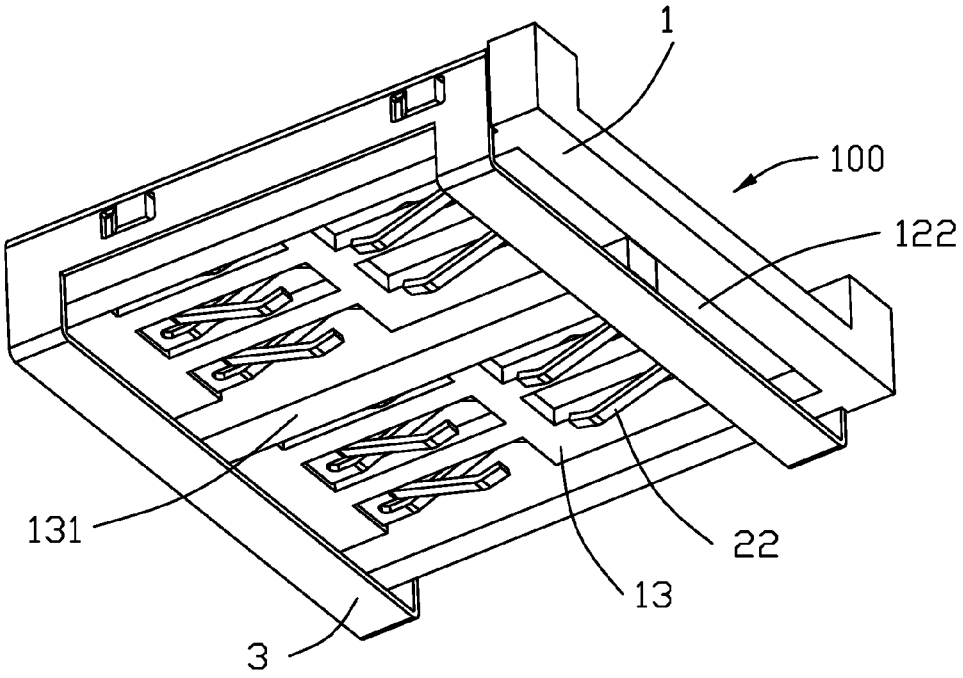
FIG. 3 is a bottom perspective view of the electrical connector shown in FIG. 1.
Figure 4:
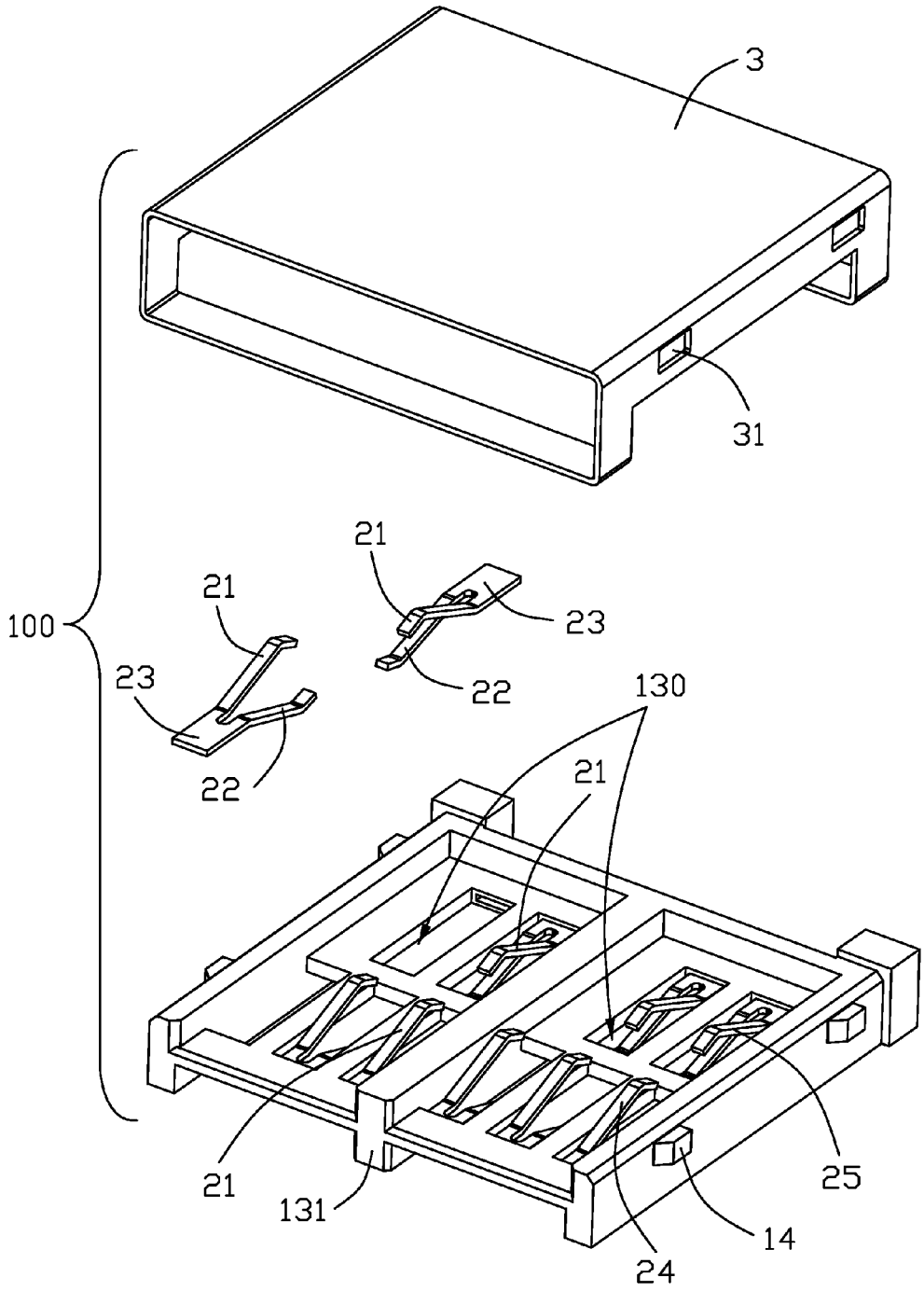
FIG. 4 is a top exploded perspective view of the electrical connector shown in FIG. 3.

Referring to FIGS. 2-4, an electrical connector 100 comprises an insulative housing 1 extending in a horizontal direction and a plurality of conductive terminals 2 retained in the insulative housing 1. The electrical connector 100 is provided with a first receiving cavity 11 and a second receiving cavity 12 which are arranged in an up-and-down arrangement in a vertical/first direction perpendicular to the horizontal direction. Each of the conductive terminals 2 comprises a first contact portion 21 extending upwardly into the first receiving cavity 11 and a second contact portion 22 extending downwardly into the second receiving cavity. The conductive terminals 2 are used to electrically connect the pair of first and second electrical components 200,300 which are respectively inserted into the first receiving cavity 11 and the second receiving cavity 12 via the first and second contact portions 21, 22 contacting with the first and second electrical components 200,300 respectively. The first contact portions 21 are electrically connected to the first electrical component 200, the second contact portions 22 are electrically connected to the second electrical component 300. The electrical connector 100 further comprises a shielding shell 3 assembled on the outer side of the insulating housing 1. The shielding shell 3 and the insulating housing 1 are surrounding together to form the first receiving cavity 11 and the second receiving cavity 12. The insulation housing 1 is provided with a convex part 14, the shielding shell 3 is provided with a locking portion 31 corresponding to the convex part 14. The convex part 14 is clamped in the locking portion 31. The insulating housing 1 comprises a plate like terminal mounting portion 13 locating between the first receiving cavity 11 and the second receiving cavity 12. The plurality of conductive terminals 2 are fixed to the terminal mounting portion 13, and the first receiving cavity 11 and the second receiving cavity 12 are provided on both sides of the terminal mounting portion 13. The terminal mounting portion 13 essentially forms a plurality of passageways 130 in which the corresponding conductive terminals 2 are received, respectively. The first receiving cavity 11 is used for insertion of the first electrical component 200. The second receiving cavity 12 is used for insertion of the second electrical component 300. The first receiving cavity 11 has a first opening 111 for insertion of the first electrical component 200. The second receiving cavity 12 has a second opening 121 for insertion the second electrical component 300. In the preferred embodiment of the present invention, the first and second openings 111,121 locates at a same side of the receiving cavity along an insertion direction perpendicular to both the vertical and horizontal directions. The terminal mounting portion 13 is provided with a limiting protrusion 131 protruding into the second receiving cavity 12 to abut against a bottom side of the second component 300. The second electrical component 300 is abutted against an abutment surface (not labeled) of the limiting protrusion 131 when the second electrical component 300 is inserted into the second receiving cavity 12. The second electrical component 300 is be confined between the limiting protrusion 131 and the shielding shell 3 after being inserted into the second receiving cavity 12. Because of the limiting effect of the limiting protrusion 131, the second electrical component 300 inserted into the second receiving cavity 12 maintain a certain distance with the surface of the terminal mounting portion 13 which faces the second receiving cavity 12. In this way, the connection of the second electrical component 300 to the conductive terminals 2 can be prevented from causing excessive deformation of the conductive terminals 2.

Referring to FIGS. 1-6, In the preferred embodiment of the present invention, the first electrical component 200 defines a slot 201 extending in the insertion direction and accommodating the limiting protrusion 131, and the second element 300 has no slot. The second receiving cavity 12 includes a space 122 locating between the limiting protrusion 131 and a lower side of the shielding shell 3 in the vertical direction to receive the second electrical component 300. The second contact portions 22 extend downwardly into the space 122 to mating with the second electrical component 300. The limiting protrusion 131 also protrudes into the first receiving cavity 11 and leans on the shielding shell 3, and therefore no space is formed between the limiting portion 131 and a upper side of the shielding shell 3 in the vertical direction. The limiting protrusion 131 protruding into the first receiving cavity 11 is located in the slot 201.

Figure 5:
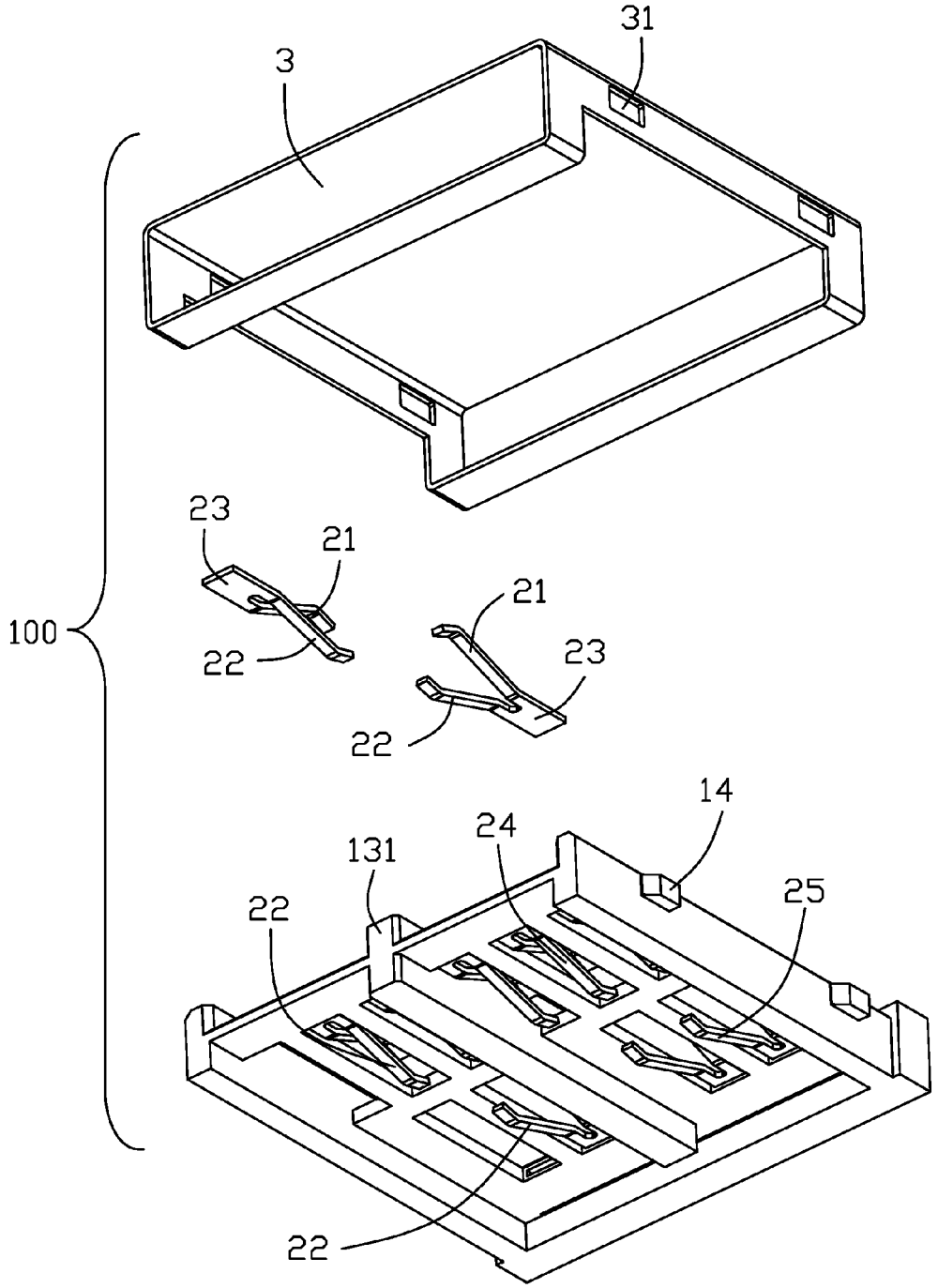
FIG. 5 is a bottom exploded perspective view of the electrical connector shown in FIG. 3.
Figure 6:
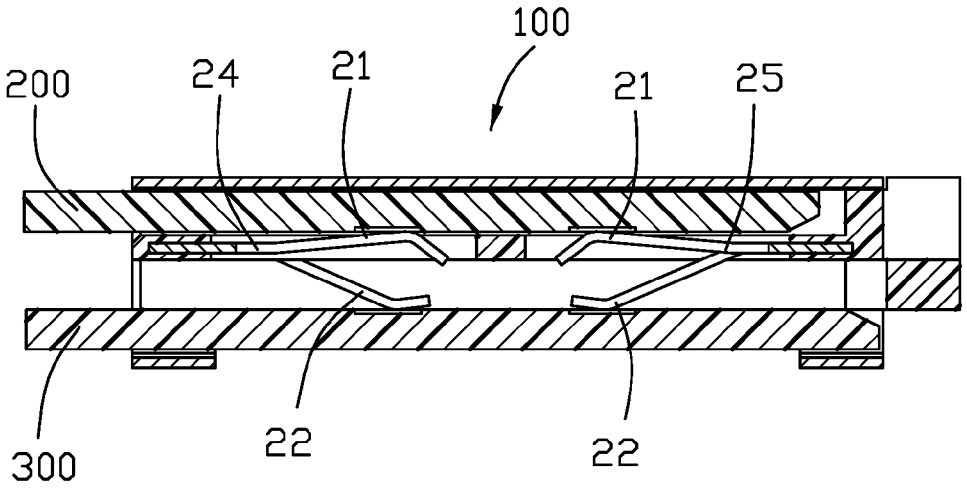
FIG. 6 is a cross-sectional view of the electrical connector assembly of FIG. 1 along line 6-6 extending along a transverse direction.

Referring to FIGS. 4-6, each of the conductive terminals 2 comprises a connecting portion 23 for connecting the first contact portion 21 and second contact portion 22 together. In the preferred embodiment of the present invention, the connecting portion 23 is embedded in the insulating housing 1 by insert molding. In other embodiments, the connecting portion 23 can be embedded in the insulating housing 1 by assembling. Both the first contact portion 21 and the second contact portion 22 are resilient. The second contact portion 22 is resiliently pressed against the second electrical component 300 after the second electrical component 300 being inserted into the second receiving cavity 12, and the second electrical component 300 is fixed at the same time. The first contact portion 21 is electrically connected with the first electrical component 200 after the first electrical component 200 being inserted into the first receiving cavity 11. The electrical connector 100 defines a front-and-rear direction, the extending direction of the first contact portion 21 and the second contact portion 22 of each of the conductive terminals 2 is the same in the front-and-rear direction. The conductive terminals 2 is generally a "Y" shape. The projections of the first contact portion 21 and the second contact portion 22 in the vertical direction do not overlap and are arranged in parallel and are arranged in parallel. The plurality of conductive terminals 2 comprise a first row of terminals 24 and a second row of terminals arranged 25 side by side in the front-and-rear direction. The first contact portion 21 of the first row of terminals 24 and the first contact portion 21 of the second row of terminals 25 extend toward each other in the front-and-rear direction. The second contact portion 22 of the first row of terminals 24 and the second contact portion 22 of the second row of terminals 25 extend toward each other in the front-and-rear direction. The second contact portion 22 is electrically connected with the second electrical component 300 after the second electrical component 300 being inserted into the second receiving cavity 12. The first contact portion 21 is electrically connected with the first electrical component 200 after the first electrical component 200 being inserted into the first receiving cavity 11. Thus, the electrical connection between the first electrical component 200 and the second electrical component 300 is achieved.

The electrical connector 100 is provided with the second receiving cavity 12 for inserting the second electrical component 300 in present invention, thereby facilitating the assembly of the second electrical component 300 and the electrical connector 100. The second electrical component 300 is strongly fixed by the elastic compression of the conductive terminals 2, and it is not necessary to solder the conductive terminals 2 to the second electrical component 300. The above process can be simplified compared with the traditional welding fixation, and the production efficiency is improved. Of course, in other embodiments, in order to better ensure the fixation of the electrical connector 100 and the second electrical component 300, other fixing means may be added thereto on this basis. In that case, the structure of the utility model has a pre-fixed effect, making the subsequent operation more convenient.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing extending in a horizontal direction;

a plurality of conductive terminals retained in the insulative housing; and a shielding shell assembled on the outer side of the insulating housing;

wherein the electrical connector is provided with a first receiving cavity and a second receiving cavity which are arranged in an up-and-down arrangement in a vertical direction perpendicular to the horizontal direction, the shielding shell and the insulating housing are surrounding together to form the first receiving cavity and the second receiving cavity, the insulating housing comprises a terminal mounting portion locating between the first receiving cavity and the second receiving cavity, each of the conductive terminals comprises a first contact portion extending upwardly into the first receiving cavity and a second contact portion extending downwardly into the second receiving cavity, the conductive terminals are used to electrically connect a pair of first and second electrical components, which are respectively inserted into the first receiving cavity and the second receiving cavity, via the first and second contact portions contacting with the first and second electrical components respectively, the terminal mounting portion is provided with a limiting protrusion protruding into the second receiving cavity to abut against the second component, the second receiving cavity includes a space locating between the limiting protrusion and a lower side of the shielding shell in the vertical direction to receive the second electrical component, the second contact portions extend downwardly into the space.

2. The electrical connector as claimed in claim 1, wherein the plurality of conductive terminals are fixed to the terminal mounting portion, the first receiving cavity and the second receiving cavity are provided on both sides of the terminal mounting portion.

3. The electrical connector as claimed in claim 2, wherein the first receiving cavity is used for insertion of a first electrical component, the second receiving cavity is used for insertion of a second electrical component.

4. The electrical connector as claimed in claim 3, wherein the first receiving cavity has a first opening for insertion of the first electrical component, the second receiving cavity has a second opening for insertion of the second electrical component, the first and second openings locates at a same side of the receiving cavity along an insertion direction perpendicular to both the vertical and horizontal directions.

5. The electrical connector as claimed in claim 1, wherein the limiting protrusion also protrudes into the first receiving cavity and leans on the shielding shell, and therefore no space is formed between the limiting portion and a upper side of the shielding shell in the vertical direction.

6. The electrical connector as claimed in claim 1, wherein each of the conductive terminals comprises a connecting portion for connecting the first contact portion and second contact portion together, the connecting portion is embedded in the insulating housing, the electrical connector defines a front-and-rear direction, the extending direction of the first contact portion and the second contact portion of each of the conductive terminals is the same in the front-and-rear direction.

7. The electrical connector as claimed in claim 6, wherein the plurality of conductive terminals comprise a first row of terminals and a second row of terminals arranged side by side in the front-and-rear direction, the first contact portion of the first row of terminals and the first contact portion of the second row of terminals extend toward each other in the front-and-rear direction, the second contact portion of the first row of terminals and the second contact portion of the second row of terminals extend toward each other in the front-and-rear direction.

8. An electrical connector assembly comprising:

an electrical connector mounted in a horizontal direction;

a first electrical component; and a second electrical component;

wherein the electrical connector comprises an insulative housing extending in the horizontal direction, a plurality of conductive terminals retained in the insulative housing, a first receiving cavity and a second receiving cavity arranged in an up-and-down arrangement in a vertical direction perpendicular to the horizontal direction, a shielding shell assembled on the outer side of the insulating housing, the shielding shell and the insulating housing are surrounding together to form the first receiving cavity and the second receiving cavity, the plurality of conductive terminals are located between the first receiving cavity and the second receiving cavity, the first electrical component is inserted into the first receiving cavity, the second electrical component is inserted into the second receiving cavity, the first electrical component and the second electrical component are electrically connected through the plurality of conductive terminals, the insulating housing comprises a terminal mounting portion locating between the first receiving cavity and the second receiving cavity, the terminal mounting portion is provided with a limiting protrusion protruding into the second receiving cavity, the second receiving cavity includes a space locates between the limiting protrusion and a lower side of the shielding shell in the vertical direction to receive the second electrical component, the limiting protrusion abuts against the second electrical component, the second contact portions extend downwardly into the space to mating with the second electrical component.

9. The electrical connector assembly as claimed in claim 8, wherein each of the conductive terminals comprises a first contact portion extending upwardly into the first receiving cavity and a second contact portion extending downwardly into the second receiving cavity, the first contact portions are electrically connected to the first electrical component, the second contact portions are electrically connected to the second electrical component.

10. The electrical connector assembly as claimed in claim 9, the limiting protrusion protruding into the first receiving cavity and leaning on the shielding shell, the first electrical component defines a slot extending in an insertion direction and accommodating the limiting protrusion.

11. An electrical connector assembly comprising:

a electrical connector including:

an insulative housing a plate like terminal mounting portion defining opposite first and second surfaces thereon in a first direction and a plurality of passageways extend therethrough in said first direction;

an first cavity and a second cavity located by the upper surface and the lower surface in said first direction, respectively, each of said first cavity and said second cavity exposed to an exterior in a second direction perpendicular to said first direction;

a first limiting protrusion and a second limitation protrusion formed on the corresponding first surface and second surface in the corresponding first cavity and second cavity, respectively;

a plurality of terminals retainably received in the corresponding passageways, respectively, each of said terminals including a resilient first contact portion extending into the first cavity in the first direction, and a resilient second contact portion extending into the second cavity in the first direction;

a first electrical component received in the first cavity and restrained by the first limiting protrusion to deflect the first contact portions of the terminals along the first direction in electrical and mechanical connection; and a second electrical component received in the second cavity and restrained by the second limiting protrusion to deflect the second contact portions of the terminals in the first direction in electrical and mechanical connection.

12. The electrical connector assembly as claimed in claim 11, wherein the first electrical component is spaced from the first surface with a first distance in the first direction, the second electrical component is spaced from the second surface with a second distance in the first direction, said first distance being different from the second distance so as to have the first contact portion and the second contact portion of each of said terminals experience different deflection deformations in the first direction.

13. The electrical connector assembly as claimed in claim 12, further including a metallic shell enclosing the housing, wherein the first cavity and the second cavity directly communicate with the metallic shell in the vertical direction so as to have both said first electrical component and said second electrical component directly restrained by the metallic shell in the vertical direction.

14. The electrical connector assembly as claimed in claim 11, wherein the first electrical component is located at a same level/plane with the first limiting protrusion in the first direction while the second electrical component and the second limiting protrusion are located at different levels/planes with regard to the terminal mounting portion, and the electrical component is spaced farther from the second surface than the second limiting protrusion is.

15. The electrical connector assembly as claimed in claim 14, and said second limiting protrusion provides an abutment surface abutting against the second electrical component in first direction.

* * * * *